US009233550B2

(12) United States Patent
Aida

(10) Patent No.: US 9,233,550 B2
(45) Date of Patent: Jan. 12, 2016

(54) PRINTING APPARATUS AND RESIDUAL INK DETECTION METHOD

(71) Applicant: CANON KABUSHIKI KAISHA, Tokyo (JP)

(72) Inventor: Takahiro Aida, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/463,868

(22) Filed: Aug. 20, 2014

(65) Prior Publication Data

US 2015/0062232 A1 Mar. 5, 2015

(30) Foreign Application Priority Data

Aug. 29, 2013 (JP) ..... 2013-178563

(51) Int. Cl.
*B41J 29/393* (2006.01)
*B41J 2/175* (2006.01)

(52) U.S. Cl.
CPC ..... *B41J 2/17566* (2013.01); *B41J 2/17526* (2013.01); *B41J 2002/17579* (2013.01)

(58) Field of Classification Search
CPC .. B41J 2/17566; B41J 11/0095; B41J 2/2146; B41J 11/002; B41J 2/0458; B41J 2/14153
See application file for complete search history.

(56) References Cited

U.S. PATENT DOCUMENTS

| | | | | |
|---|---|---|---|---|
| 5,775,164 | A | 7/1998 | Kishi | |
| 6,745,626 | B2 | 6/2004 | Usui et al. | |
| 6,793,305 | B2 | 9/2004 | Tsukada et al. | |
| 7,011,385 | B2 | 3/2006 | Kitabatake et al. | |
| 7,497,561 | B2 | 3/2009 | Hashimoto | |
| 7,954,915 | B2 * | 6/2011 | Teshigawara et al. | 347/7 |
| 8,591,012 | B2 * | 11/2013 | Yoshino et al. | 347/85 |
| 8,840,220 | B2 * | 9/2014 | Taniguchi et al. | 347/19 |

FOREIGN PATENT DOCUMENTS

| | | |
|---|---|---|
| CN | 1274646 | 11/2000 |
| CN | 1460842 | 12/2003 |
| CN | 1535831 | 10/2004 |
| CN | 1663800 | 9/2005 |
| CN | 101038917 | 9/2007 |
| JP | H09-145451 | 6/1997 |
| JP | 2003-291367 | 10/2003 |
| JP | 2007-147640 | 6/2007 |
| JP | 2007-268805 A | 10/2007 |
| JP | 4656062 | 1/2011 |

* cited by examiner

*Primary Examiner* — Lamson Nguyen
(74) *Attorney, Agent, or Firm* — Fitzpatrick, Cella, Harper & Scinto

(57) ABSTRACT

An embodiment of this invention is directed to discriminating between an ink present state and a bubble state and accurately determining the presence/absence of ink in residual ink detection. A printing apparatus measures the voltage between two electrodes in an ink tank based on an electric current supplied to one of the two electrodes, and compares the measured voltage with a first threshold voltage. When the measured voltage is lower than the first threshold voltage, the measured voltage is compared with a second threshold voltage lower than the first threshold voltage. According to results of these two comparisons, control is performed to supply the electric current, re-measure the voltage between the two electrodes, and re-inspect a residual ink amount. In a case where accurate determination is suspected, the presence/absence of ink is determined by re-inspection.

19 Claims, 13 Drawing Sheets

P1
P2
P3
P4
Inksel1, Inksel0
00b(SELECT COLOR Y )
Inkon0
Inkdis
Req
t0
t1
t0
ACQUIRED AD VALUE
Vs0
Vs1

SW1
OFF
ON
OFF
OFF
SW2
OFF
OFF
ON
OFF
STATE
OPEN
CHARGE
DISCHARGE
OPEN

V
Vt0
Vs1
Vs0
Vs0
t
T0
T1
T2
T0
M1
M2

PRINTING APPARATUS AND RESIDUAL INK DETECTION METHOD

BACKGROUND OF THE INVENTION

1. Field of the Invention

The present invention relates to a printing apparatus and a residual ink detection method and, more particularly, to, for example, an inkjet printing apparatus having an arrangement for detecting residual ink in an ink tank using an electrode and a residual ink detection method.

2. Description of the Related Art

In recent years, inkjet printing apparatuses (to be referred to as printing apparatuses hereinafter) have been widespread, each of which discharges ink from the nozzles of a printhead to a printing medium such as a printing paper sheet and applies the ink onto the printing medium to form dots, thereby performing printing. Each nozzle of the printhead is provided with a discharge energy generation element such as a heater or a piezoelectric element. The nozzle is made to discharge ink by applying an electrical signal to the element.

In such a printing apparatus, the ink to be consumed by the printhead is supplied from an ink tank attached to the printing apparatus main body. Hence, when the printing apparatus continues printing regardless of a shortage of the ink amount in the ink tank, the ink cannot be discharged in a regular discharge amount, and a fault such as density unevenness occurs in the printed image. Especially in a thermal printing apparatus that discharges ink using a heater, if an electrical signal is applied to the heater in a state in which no ink remains in the printhead, the load of discharge energy may directly be applied to the nozzle surface, and the head may malfunction.

To solve this problem, such a printing apparatus conventionally has an arrangement for detecting a low residual ink level in the ink tank. Detecting a low residual ink level in the ink tank will be referred to as residual ink detection hereinafter. As the residual ink detection method, an optical method, a mechanical method, and an electrode method have been put into practical use. In particular, the electrode method is widely used because it need not a complex arrangement and can be manufactured at low cost.

Residual ink detection by the electrode method measures a voltage value generated upon supplying an electric current to a pair of electrodes inserted into the ink tank, and compares the detected voltage value with a threshold voltage provided for the detected voltage, thereby detecting the presence/absence of ink. In the residual ink detection by the electrode method, however, if bubbles generated when supplying ink to the printhead remain in the ink tank, the electric current may go through via the bubbles between the electrodes even if no ink exists in fact. Hence, the detected voltage may exhibit a value similar to that in the presence of ink, and the presence of ink may erroneously be detected although no ink remains in fact.

For example, an air communicating ink supply system introduces the air, thereby supplying ink to the printhead while maintaining pressure equilibrium. The outside air introduced at this time along with ink consumption normally changes to bubbles in the ink layer of the ink tank, and the bubbles dissipate upon moving to the air layer. However, for example, when high-duty images are continuously printed, the bubbles may remain in the ink tank without dissipating upon moving to the air layer. Such bubble formation in the ink tank may occur even in a supply system of another type.

Japanese Patent Laid-Open No. 2007-268805 proposes a method of measuring a voltage value at time 1 and time 2 (time 1<time 2) during an energization period, providing threshold voltages to the respective times, and comparing the voltage value with threshold voltages, thereby discriminating three states: an ink present state, an ink absent state, and a bubble present state.

Japanese Patent Laid-Open No. 2007-268805 utilizes a characteristic representing that a stepwise voltage characteristic is obtained with respect to the energization time in the bubble present state. In the bubble present state, no large difference is generated with respect to the voltage characteristic in the ink present state during the normal measurement time. For this reason, if the voltage value exhibits an intermediate value within a certain range at time 1, energization is continued up to a time at which the voltage value abruptly increases. The voltage is measured at time 2, and it is confirmed whether or not the voltage value exceeds a predetermined threshold voltage. If the voltage value exceeds the threshold voltage, the bubble present state is determined, and the ink is regarded to be absent. In addition, even when the ink is consequently regarded to be present, if the voltage value at time 1 exhibits the intermediate value a plurality of times upon repetitively executing residual ink detection, the ink is regarded to be absent regardless of the voltage value at time 2.

However, during the energization period, the voltage value gradually increases along with the elapse of time in any of the ink present state and the bubble present state, and the voltage is saturated. It is therefore difficult to observe a non-conducting state between the electrodes by prolonging the energization period. Additionally, from the viewpoint of the measurement period, prolonging the energization period means requiring a long time until completion of measurement of inks of all colors. Furthermore, in the method of repetitively detecting the intermediate potential to discriminate the bubble state, re-execution of residual ink detection is necessary. Hence, time is required until a discrimination result is obtained.

SUMMARY OF THE INVENTION

Accordingly, the present invention is conceived as a response to the above-described disadvantages of the conventional art.

For example, a printing apparatus and a residual ink detection method according to this invention are capable of accurately detecting the presence/absence of residual ink in an ink tank in a short time using electrodes.

According to one aspect of the present invention, there is provided a printing apparatus comprising: an ink tank in which two electrodes are internally provided; a measurement unit configured to measure a voltage between the two electrodes by supplying an electric current to one of the two electrodes; a determination unit configured to determine that ink does not exist in the ink tank in a case where the voltage measured by the measurement unit is higher than or equal to a first threshold voltage, and determine that the ink exists in the ink tank in a case where the measured voltage is lower than or equal to a second threshold voltage lower than the first threshold voltage; and a control unit configured to control to cause the measurement unit to perform re-measurement in a case where the voltage measured by the measurement unit is higher than the second threshold voltage and lower than the first threshold voltage.

According to another aspect of the present invention, there is provided a residual ink detection method in a printing apparatus including an ink tank in which two electrodes are internally provided. The method comprises: supplying an electric current to one of the two electrodes and measuring a voltage between the two electrodes; determining that ink does not exist in the ink tank in a case where the measured voltage is higher than or equal to a first threshold voltage; determining that the ink exists in the ink tank in a case where the measured voltage is lower than or equal to a second threshold voltage lower than the first threshold voltage; and controlling to perform re-measurement in case where the measured voltage is higher than the second threshold voltage and lower than the first threshold voltage.

The invention is particularly advantageous since it is possible to accurately detect the presence/absence of residual ink in a short time. According to this invention, the measured voltage is compared with two thresholds, and only when it is difficult to determine the presence/absence of residual ink, re-inspection of the residual ink is performed. Hence, in most cases, detection is done in a short time without re-inspection. In addition, since re-inspection of the residual ink is performed only when the presence/absence of residual ink is difficult to determine, more accurate detection can be performed.

Further features of the present invention will become apparent from the following description of exemplary embodiments (with reference to the attached drawings).

DESCRIPTION OF THE EMBODIMENTS

Figure 1:
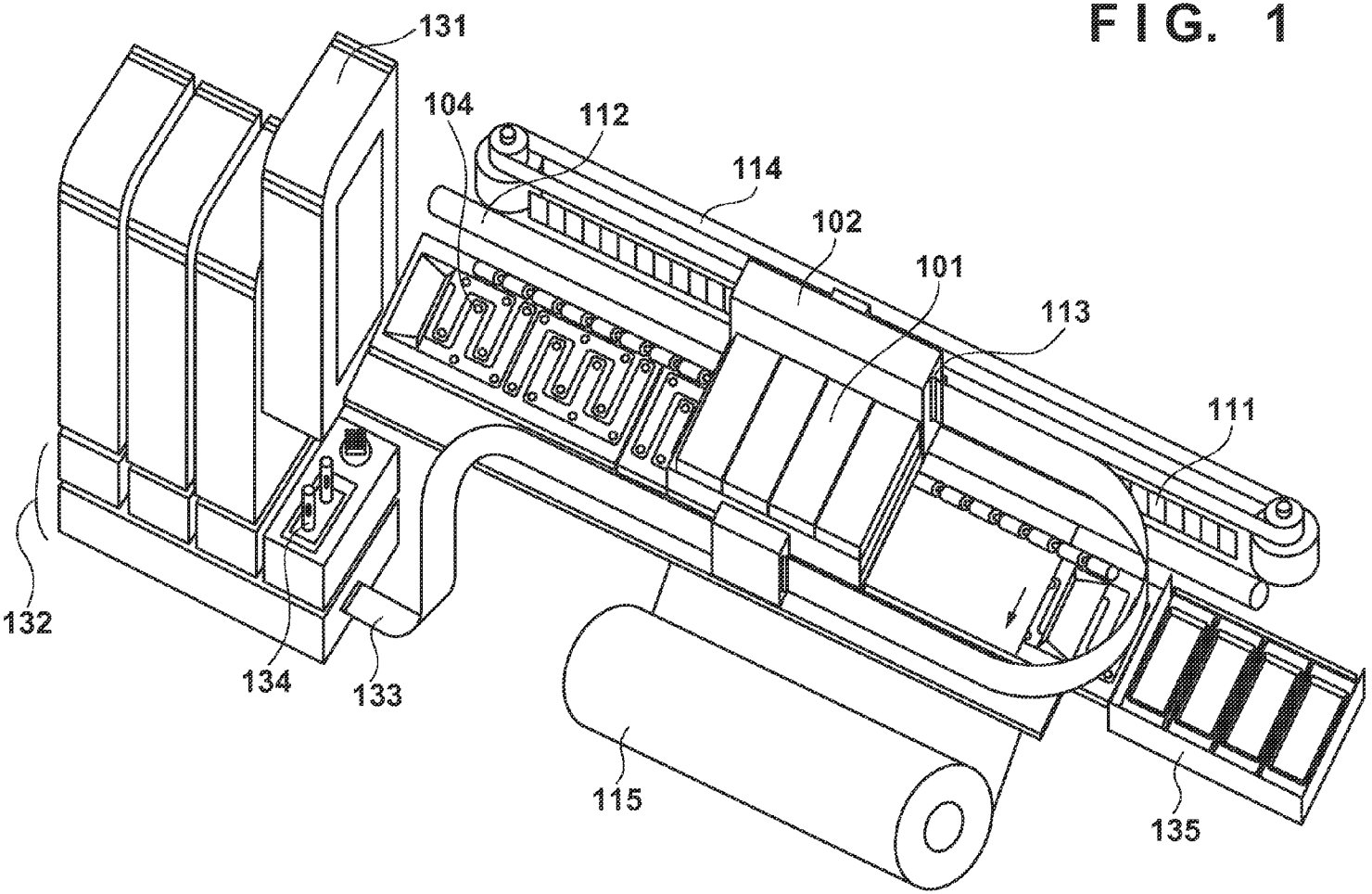
FIG. 1 is a schematic perspective view showing the internal arrangement of an inkjet printing apparatus according to an exemplary embodiment of the present invention.

Exemplary embodiments of the present invention will now be described in detail in accordance with the accompanying drawings. Note that the same reference numerals denote already explained parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

<Description of Inkjet Printing Apparatus (FIG. 1)>

FIG. 1 is a schematic perspective view showing the overall arrangement of an inkjet printing apparatus according to an exemplary embodiment of the present invention.

As shown in FIG. 1, an inkjet printhead (to be referred to as a printhead hereinafter) 101 is mounted on a carriage 102. The carriage 102 is connected to a driving mechanism formed from a carriage motor (not shown), a driving belt 114, and a shaft 112, and can scan the printhead 101 in a scanning direction perpendicular to the conveyance direction (indicated by an arrow in FIG. 1) of a printing medium 115.

An encoder scale 111 is provided on a plane facing the carriage 102. The encoder scale 111 is irradiated with light emitted by an encoder 113 and outputs a signal associated with the scanning position of the carriage 102 based on the transmitted light.

A platen 104 is provided so as to face a discharge surface where the orifices (not shown) of the printhead 101 are formed, and the carriage 102 including the printhead 101 is reciprocally moved. At the same time, a print signal is supplied to the printhead 101 to discharge ink, thereby printing the printing medium 115 conveyed onto the platen.

In a non-printing region that is a region within the reciprocal movement range of the printhead 101 and outside the passage range of the printing medium 115, a recovery unit 135 is arranged so as to face the ink discharge surface of the printhead 101.

Ink tanks 131 that contain respective inks are detachably attached to an ink tank supply unit 132 in correspondence with the colors of the inks to be discharged from the printhead 101. When the ink tanks 131 are attached to the ink tank supply unit 132, the inks of the respective colors stored in the ink tanks 131 can individually be supplied to the nozzle arrays of the printhead 101 via an ink tube 133. A pair of electrodes 134 are provided at the attachment portion between the ink tank supply unit 132 and each ink tank 131.

<Arrangement of Residual Ink Detection by Electrode Method (FIGS. 2A to 4)>

FIGS. 2A to 2D are views showing the arrangement of residual ink detection by an electrode method.

Figure 2A:
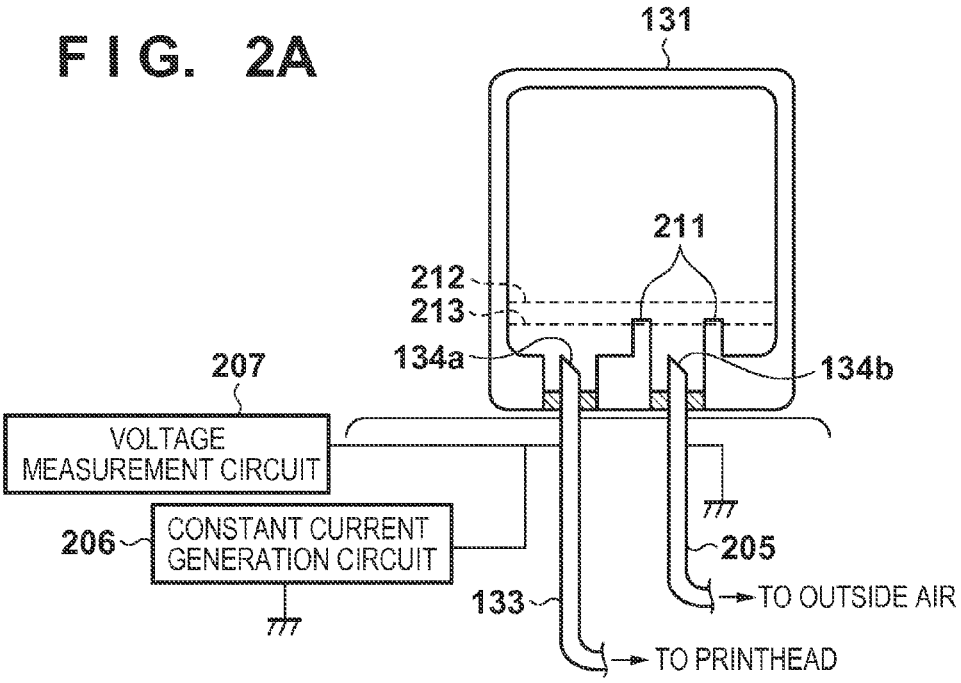
FIGS. 2A, 2B, 2C, and 2D are views showing the arrangement of residual ink detection by an electrode method.
Figure 2B:
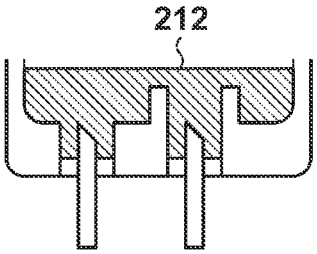

The pair of electrodes 134 shown in FIG. 1 are illustrated as electrodes 134*a* and 134*b* in FIG. 2A, which are disposed in parallel on the ink tank supply unit 132. The electrode 134*a* is a hollow pin configured to supply ink from the ink tank containing the ink to the printhead 101 via the ink tube 133. The electrode 134*b* is a hollow pin configured to introduce outside air into the ink tank via a tube 205. One electrode 134*a* is connected to a constant current generation circuit 206, and the other electrode 134*b* is grounded. The electrode 134*a* is also connected to a voltage measurement circuit 207 configured to measure the voltage value between the electrodes.

The ink tank 131 is attached to the ink tank supply unit 132. A rubber packing is provided on the ink tank 131. When the electrodes 134*a* and 134*b* are inserted into the ink tank 131, the rubber packing prevents the ink in the ink tank 131 from leaking from the insertion portion. In addition, barriers 211 are provided in the ink tank. When the ink tank is attached, the electrode 134*b* is surrounded by the barriers 211.

Figure 2C:
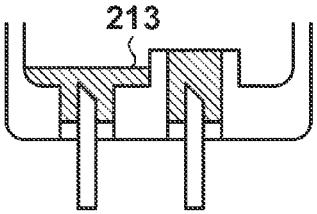
Figure 2D:
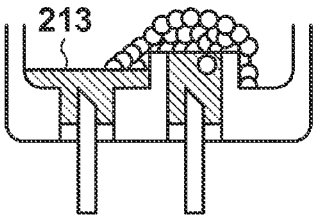

When ink is consumed by the printhead, the ink is extracted from the electrode 134*a*, and air corresponding to the extracted ink amount is introduced from the electrode 134*b*. When ink consumption progresses, the liquid level in the ink tank lowers. Upon residual ink detection, a state 212 in which the ink level is higher than the barriers 211 is regarded as an ink present state (FIG. 2B), and a state 213 in which the ink level is lower is regarded as the ink absent state (FIG. 2C). Note that FIG. 2D shows a state in which bubbles are formed when the ink level lowers.

Figure 3:
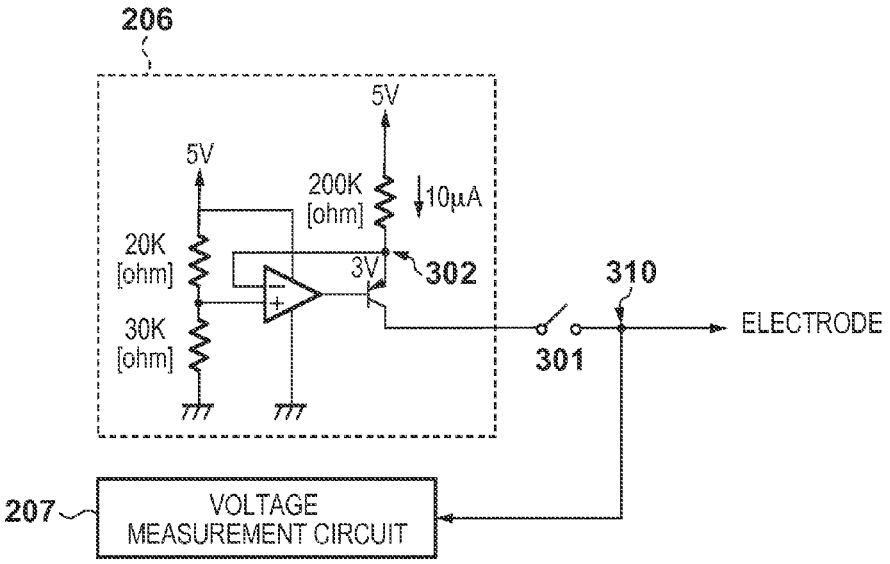
FIG. 3 is a circuit diagram showing the detailed arrangement of a constant current generation circuit.
Figure 4:
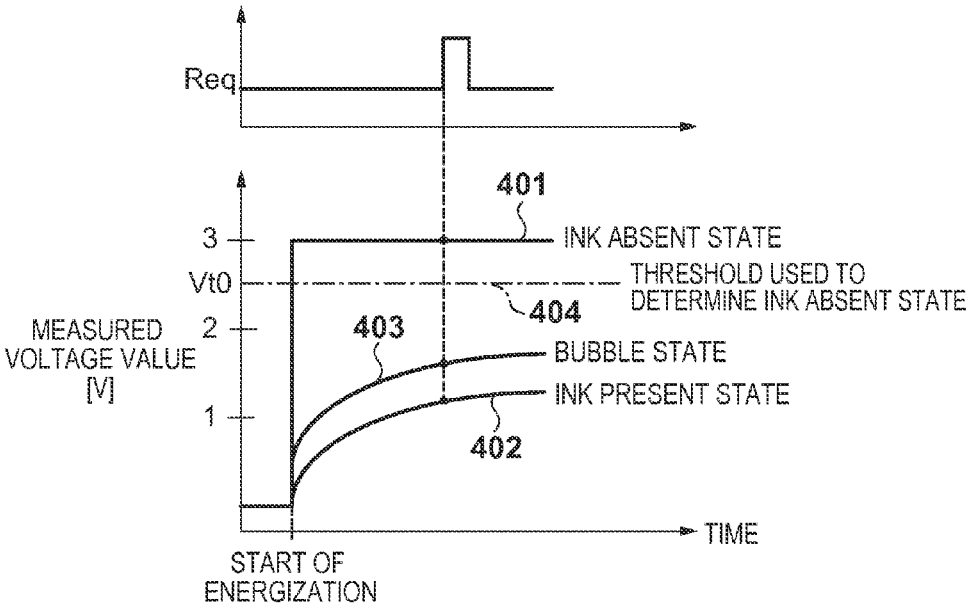
FIG. 4 is a timing chart showing an example of a voltage waveform measured at a point 310 shown in FIG. 3.

FIG. 3 is a circuit diagram showing an example of the circuit arrangement of the constant current generation circuit 206 shown in FIG. 2A. FIG. 4 is a timing chart showing an example of a voltage waveform measured at a point 310 shown in FIG. 3.

At the time of residual ink detection, a switch 301 is turned on to supply a constant current from the constant current generation circuit 206 to the electrode 134*a*. In this arrangement, the constant current value is 10 μA, and the voltage at a point 302 is 3 V. The voltage measurement circuit 207 uses an A/D converter, and samples and measures the voltage value at the point 310 at the rising timing of the pulse of a measurement request signal Req, as shown in FIG. 4.

If no ink is present between the electrodes 134*a* and 134*b*, the two electrodes are in a non-conducting state and have the same potential as the point 302 of the constant current generation circuit. For this reason, the voltage measurement circuit 207 detects the voltage value at the point 302 (line 401 in FIG. 4).

On the other hand, in the ink present state, the electric current goes through between two electrodes via the ink. Hence, the voltage measurement circuit 207 detects the sum of a voltage value corresponding to (resistance value of ink)× (constant current value) and a voltage value derived from charges accumulated in the capacitive component depending to the energization time. For this reason, in the ink present state, a voltage lower than the voltage value of 3 V at the point 302 (curve 402 in FIG. 4) is detected. Therefore, if a predetermined threshold voltage value is provided, the ink present and absent states can be detected. However, since the resistance value of ink changes to some extent depending on the ink amount, ink composition, and the like, the threshold voltage value is set to a value Vt0 close to the voltage value at the point 302 regarded as the ink absent state (alternate long and short dashed line 404 in FIG. 4).

Normally, in the state 213 in which the ink level is lower than the barriers 211 in the ink tank, the electrodes become to be in the non-conducting state. However, in a state (to be referred to as a bubble state hereinafter) in which bubbles are accumulated in the ink tank, as shown in FIG. 2D, the electric current goes through between the electrodes via the bubbles. For this reason, even in the ink absent state, the electrodes have an intermediate potential, and the ink absent state cannot correctly be detected (curve 403 in FIG. 4).

<Control Configuration of Inkjet Printing Apparatus (FIG. 5)>

Figure 5:
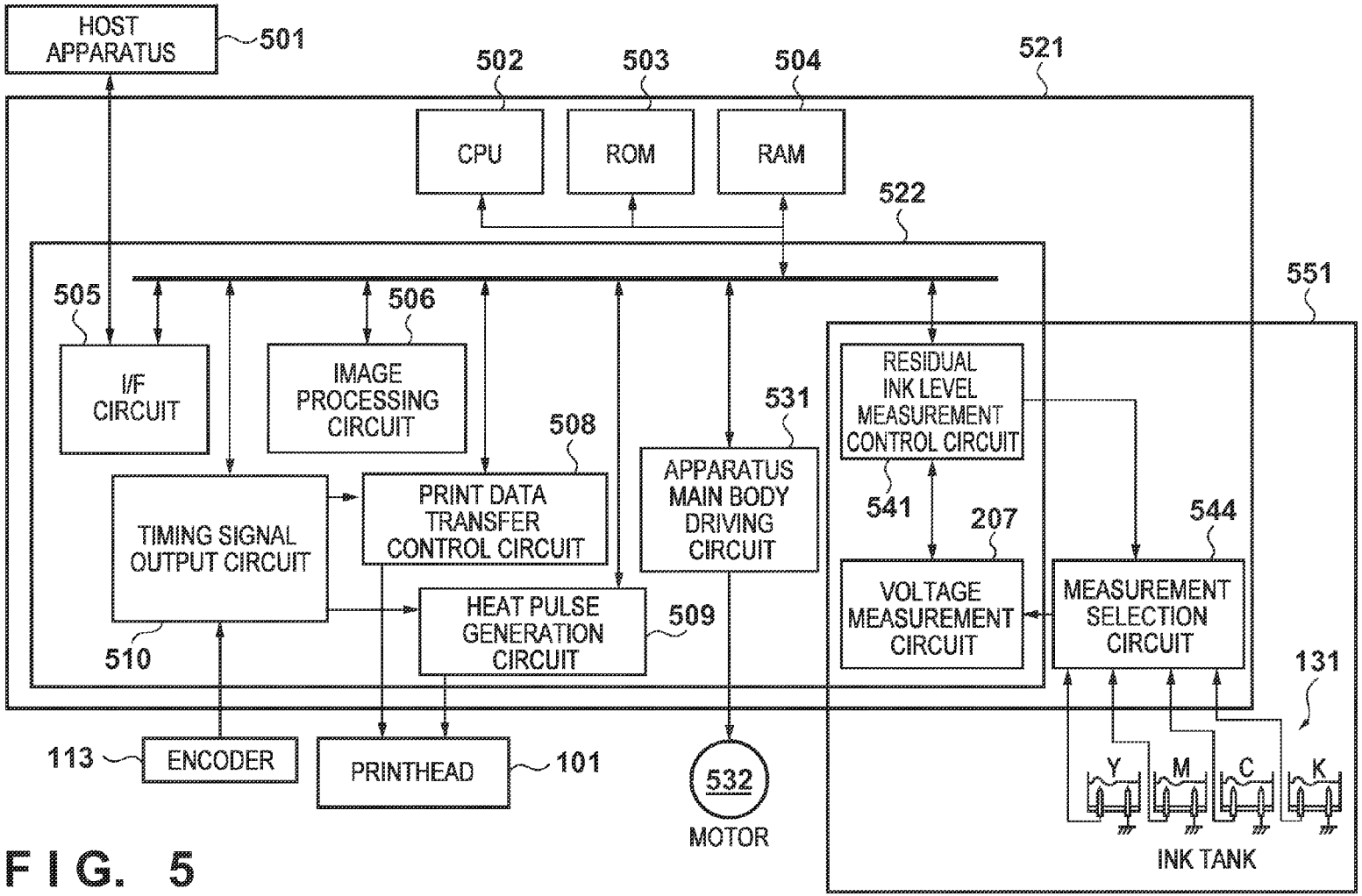
FIG. 5 is a block diagram showing the control configuration of the printing apparatus shown in FIG. 1.

FIG. 5 is a block diagram showing the control configuration of the printing apparatus shown in FIG. 1.

A control command or print data transmitted from a host apparatus 501 is received by an interface (I/F) circuit 505 in an ASIC 522 arranged on a control board 521. A ROM 503 stores programs to be used by a CPU 502 to operate, various kinds of tables necessary for control of the printhead 101, and the reference voltage value between the electrodes which is generated when applying the constant current in a state in which ink is supplied into each tank by a cleaning or ink refill operation. The CPU 502 controls the entire printing apparatus in accordance with the programs stored in the ROM 503 in advance or a control command input from the host apparatus 501 via the I/F circuit 505.

Print data received by the interface (I/F) circuit 505 is sent to an image processing circuit 506, undergoes various kinds of image processing according to the printing method, and is stored in, for example, a RAM 504 such as a DRAM. The RAM 504 includes a print buffer that stores column data, a work area used for execution of the programs by the CPU 502, and a reception buffer that temporarily holds control data and print data received from the host apparatus 501 via the interface circuit 505.

A timing signal output circuit 510 receives the signal of position information of the carriage 102 output from the encoder 113 and then outputs timing signals for the operations of the respective circuits to the image processing circuit 506, a print data transfer control circuit 508, and a heat pulse generation circuit 509.

In accordance with the timing signal from the timing signal output circuit 510, the image processing circuit 506 reads out print data from the RAM 504 and transfers it to the print data transfer control circuit 508. Upon receiving the print data, the print data transfer control circuit 508 performs data processing corresponding to the printhead driving method, generates head driving data, and temporarily stores it in an SRAM (not shown). The heat pulse generation circuit 509 generates a heat pulse based on the divided pulse width modulation driving method. The head driving data read from the SRAM and heat pulse generation are performed based on the timing signals from the timing signal output circuit 510, and the head driving data and the heat pulse are output to the printhead 101.

An apparatus main body driving circuit 531 drives a motor 532 and controls sensors (not shown). An enclosed portion 551 shown in FIG. 5 indicates the arrangement of residual ink detection using an electrode method, which will be explained together with FIG. 6 to be described later.

<Control Configuration of Residual Ink Detection by Electrode Method (FIG. 6)>

Figure 6:
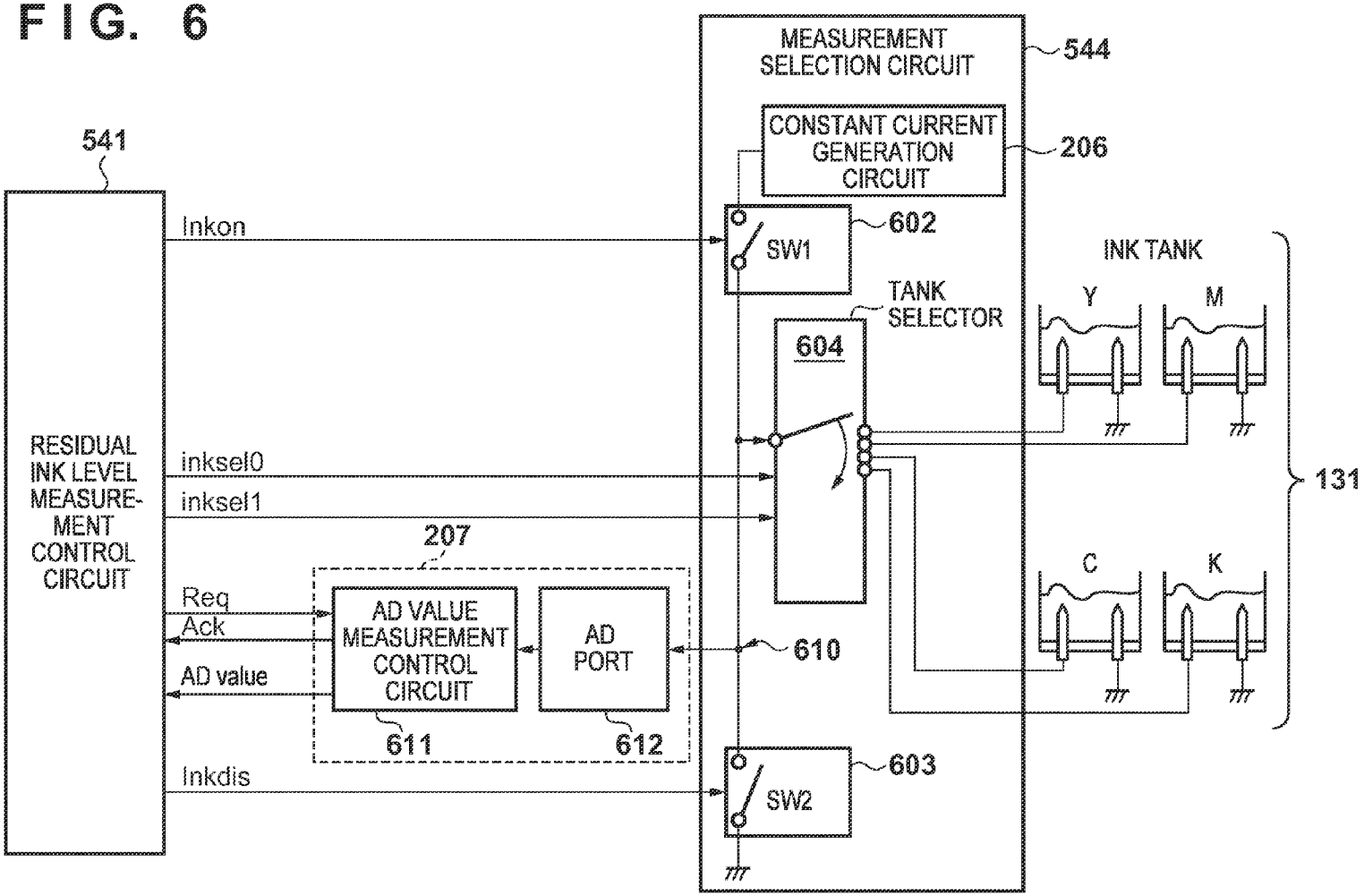
FIG. 6 is a block diagram showing the control configuration of the residual ink detection by the electrode method, that is, the detailed arrangement of an enclosed portion 551 shown in FIG. 5.

FIG. 6 is a block diagram showing the control configuration of the residual ink detection by the electrode method, that is, the detailed arrangement of the enclosed portion 551 shown in FIG. 5.

A measurement selection circuit 544 includes the constant current generation circuit (constant current source) 206, a switch (SW1) 602 configured to supply the constant current, a tank selector 604 configured to select an ink tank for which the detection is to be performed, and a switch (SW2) 603 connected to GND for discharge. These elements operate based on control signals from a residual ink level measurement control circuit 541. The voltage measurement circuit 207 includes an AD value measurement control circuit 611 and an A/D port 612. The AD value measurement control circuit 611 reads the voltage value at a point 610 from the A/D port 612 in accordance with the sending timing of the measurement request signal Req from the residual ink level measurement control circuit 541. The acquired voltage value is stored in a register (not shown) of the residual ink level measurement control circuit 541. When comparing the voltage value with the threshold voltage, the CPU 502 performs the comparison by referring to the register. When the AD value measurement control circuit 611 receives the measurement request signal Req from the residual ink level measurement control circuit 541, the AD value measurement control circuit 611 acknowledges the request by sending an acknowledgement signal Ack.

The residual ink level measurement control circuit 541 controls the measurement selection circuit 544 and the AD value measurement control circuit 611. The tank selector 604 switches the measurement color ink to be selected in accordance with signals inksel0 and inksel1. For example, when both signals are at level "Low" (00b), an ink tank Y (storing yellow ink) is selected. The switch (SW1) 602 is turned on when an signal Inkon is at level "H", and connected to the ink tank of an ink color designated by the signals inksel0 and inksel1 in the tank selector 604. The constant current generation circuit 206 thus supplies the constant current to the designated ink tank. When the measurement request signal Req is generated, the AD value measurement control circuit 611 reads the AD value, and outputs the read AD value to the residual ink level measurement control circuit 541. The switch (SW2) 603 is turned on when a signal Inkdis is at level "H", and connected to the ground side.

With the above-described two switches (SW1, SW2) 602 and 603, the electrodes can be switched between three states: charge, discharge, and open. For example, when the switch (SW1) 602 is turned on, and the switch (SW2) 603 is turned off, the charge state is obtained. When SW1 is turned off, and SW2 is turned on, the discharge state is obtained. When SW1 is turned off, and SW2 is turned off, the open state is obtained. Note that the switch (SW1) 602 will also be referred to as a first switch, and the switch (SW2) 603 as a second switch.

<Timing Charts of Residual Ink Detection (FIGS. 7A to 7C)>

Figures 7A, 7B, 7C:
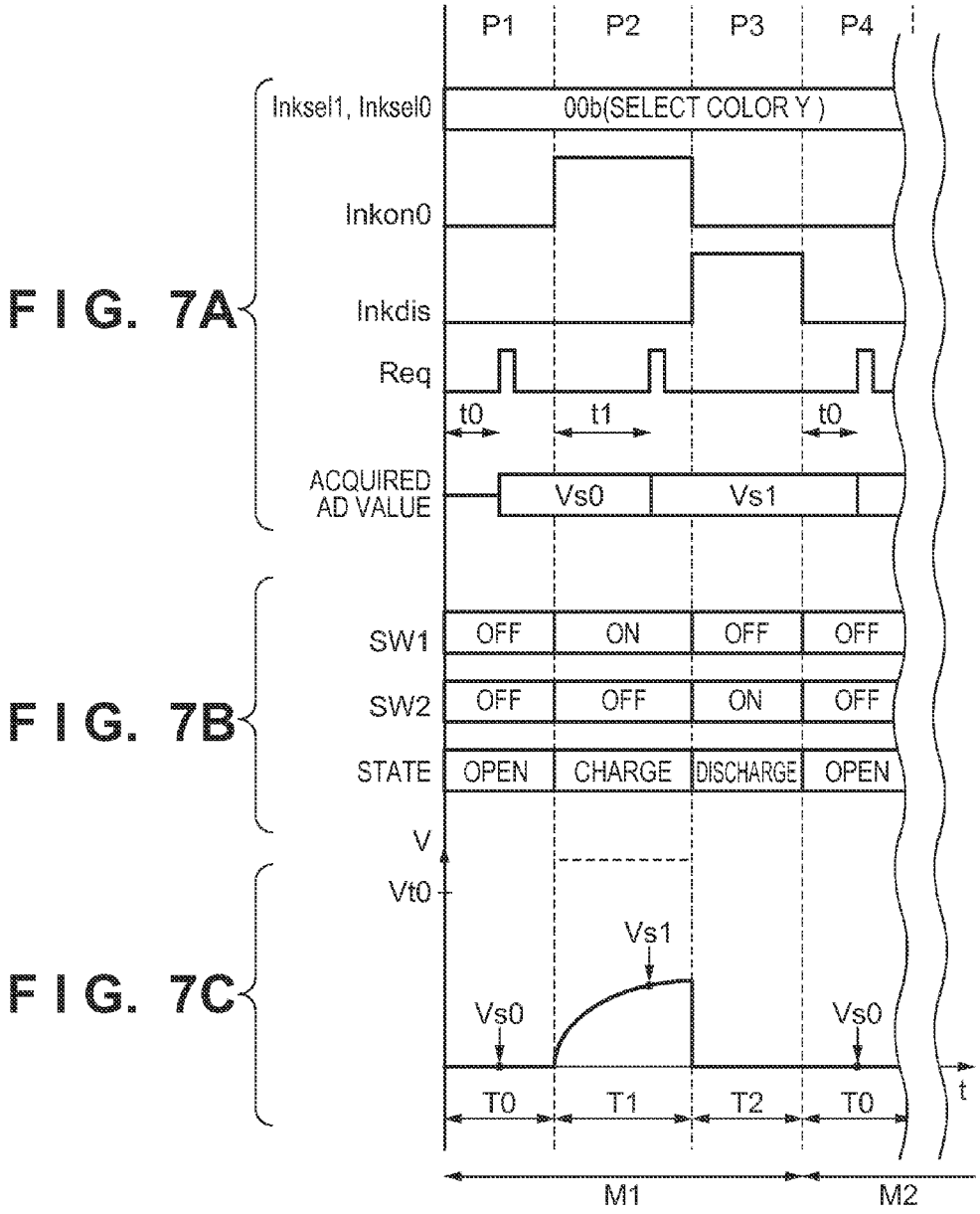
FIGS. 7A, 7B, and 7C are timing charts of residual ink detection.

FIGS. 7A to 7C are timing charts of residual ink detection.

FIG. 7A shows a change in the control signal of the residual ink level measurement control circuit 541. FIG. 7B shows the states of the switch (SW1) 602 and the switch (SW2) 603 and the state of the electrodes. FIG. 7C shows the voltage waveform at the point 610.

In FIG. 7A, "00b" is set when both the signals inksel0 and inksel1 are at level "Low", and the ink tank storing yellow ink (Y) is selected. In a section P1, the signals Inkon0 and Inkdis are at level "Low" during an open period T0 (see FIG. 7C). As shown in FIG. 7B, the switch (SW1) and the switch (SW2) are off, and the electrodes are in the open state.

Next, in a section P2, the signal Inkon0 is at level "High", and the signal Inkdis is at level "Low" during a period T1 (see FIG. 7C). As shown in FIG. 7B, the switch (SW1) is on, the switch (SW2) is off, and the electrodes are in the charge state. Finally, in a section P3, the signal Inkon0 is at level "Low", and the signal Inkdis is at level "High" during a period T2 (see FIG. 7C). As shown in FIG. 7B, the switch (SW1) is off, the switch (SW2) is on, and the electrodes are in the discharge state.

Voltage value acquisition is done in a time t0 during the period (section P1) T0 where the electrodes are in the open state (t0 is a predetermined time, for example, 64 μs before the open state ends), and a voltage value Vs0 at the point 610 at that time is acquire as the AD value. Voltage value acquisition is also done in a time t1 during the charge period T1 (section P2) (t1 is a predetermined time, for example, 64 μs before the charge state ends), and a voltage value Vs1 is acquire as the AD value. The acquired AD values are stored in register 1 and register 2 of the residual ink level measurement control circuit 541, respectively.

The acquired AD value Vs1 is compared with the threshold voltage Vt0, thereby determining the presence/absence of ink. The sections P1 to P3, which are collectively indicated as M1, can be repeated (from P4, which is also indicated as M2).

<Voltage Waveform at Point 610 when Charge, Discharge, and Open are Sequentially Performed (FIGS. 8A, 8B and 9)>

Figure 8A:
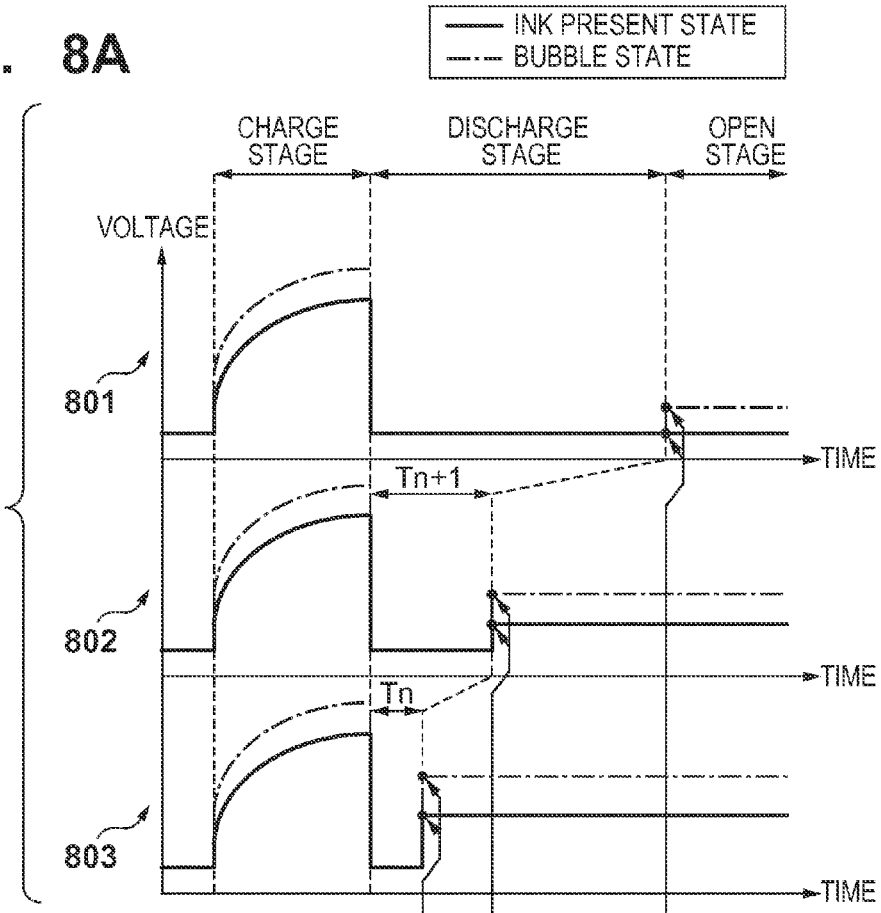
FIGS. 8A and 8B are timing charts showing voltage waveforms at a point 610 shown in FIG. 6 when charge, discharge, and open are sequentially performed.
Figure 8B:
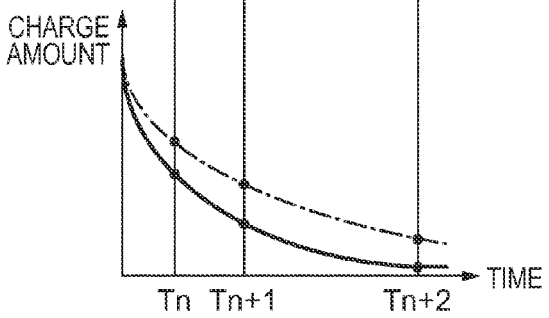

FIGS. 8A and 8B are timing charts showing voltage waveforms at the point 610 when charge, discharge, and open are sequentially performed. Referring to FIG. 8A, 801 to 803 represent examples of voltage waveforms measured at the point 610 when charge, discharge, and open are sequentially performed in different discharge times. FIG. 8B shows removal of charges accumulated between the electrodes at the time of discharge. Referring to FIGS. 8A and 8B, a solid line indicates the waveform of a change in a voltage and charge amount measured in the ink present state, and an alternate long and short dashed line indicates the waveform of a voltage and charge amount measured in the bubble state.

The waveform (solid line) in the ink present state will be described first.

When discharge is sufficiently performed, the charges between the electrodes are sufficiently removed until a time $T_{n+2}$ in FIG. 8B, and therefore, the potential in the open state rarely appears (801 in FIG. 8A). When discharge is not sufficiently performed, the charges between the electrodes are not sufficiently removed, as indicated at times $T_n$ and $T_{n+1}$ in FIG. 8B, and therefore, a potential by residual charges in the open state is generated (802 and 803 in FIG. 8A).

The waveform (alternate long and short dashed line) in the bubble state will be described next.

Focus the time $T_{n+2}$ in FIG. 8B. Since the discharge time that is sufficient in the ink present state is insufficient in the bubble state, and residual charges exist, a potential by the residual charges in the open state is generated (801 in FIG. 8A). Focus the times $T_n$ and $T_{n+1}$ in FIG. 8B. The residual charge amount in the bubble state is larger than in the ink present state. For this reason, the potential generated by the residual charges in the open state is higher than in the ink present state (802 and 803 in FIG. 8A).

Figure 9:
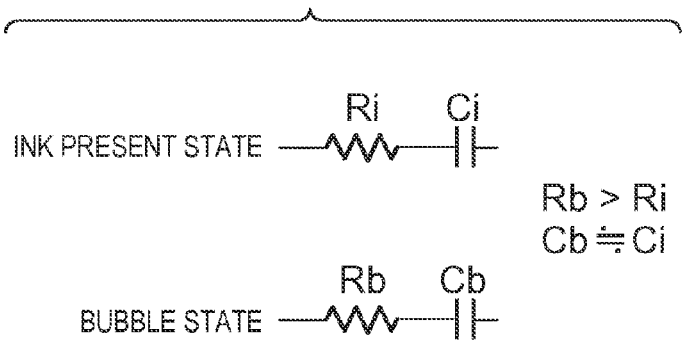
FIG. 9 is a view showing equivalent circuits each representing the electrical relationship between ink and a portion including electrodes.

FIG. 9 is a view showing equivalent circuits each representing the electrical relationship between ink and a portion including the electrodes. As shown in FIG. 9, the electrical characteristic of ink or bubbles can be represented by a capacitive component C and a resistive component R. In the bubble state, the contact area between the electrodes and the ink decreases. Hence, a resistive component Rb in the bubble state is larger than a resistive component Ri in the ink present state, that is, Rb>Ri. On the other hand, a capacitive component Cb in the bubble state and a capacitive component Ci in the ink present state hold a relationship Cb≈Ci. Hence, the discharge curves of charges change because of the difference in the resistive component, as shown in FIG. 8B.

A method of discriminating between the ink present state and the bubble state using a voltage value generated by residual charges caused by the difference in the discharge curve as described above will be described next.

<Method of Deciding Charge Time T1, Threshold Voltage Vt0, and Threshold Voltage Vt1 in Normal Sequence (FIG. 10)>

The charge time T1, the threshold voltage Vt0, and another threshold voltage Vt1 in the normal sequence can be decided using a method to be described below.

Figure 10:
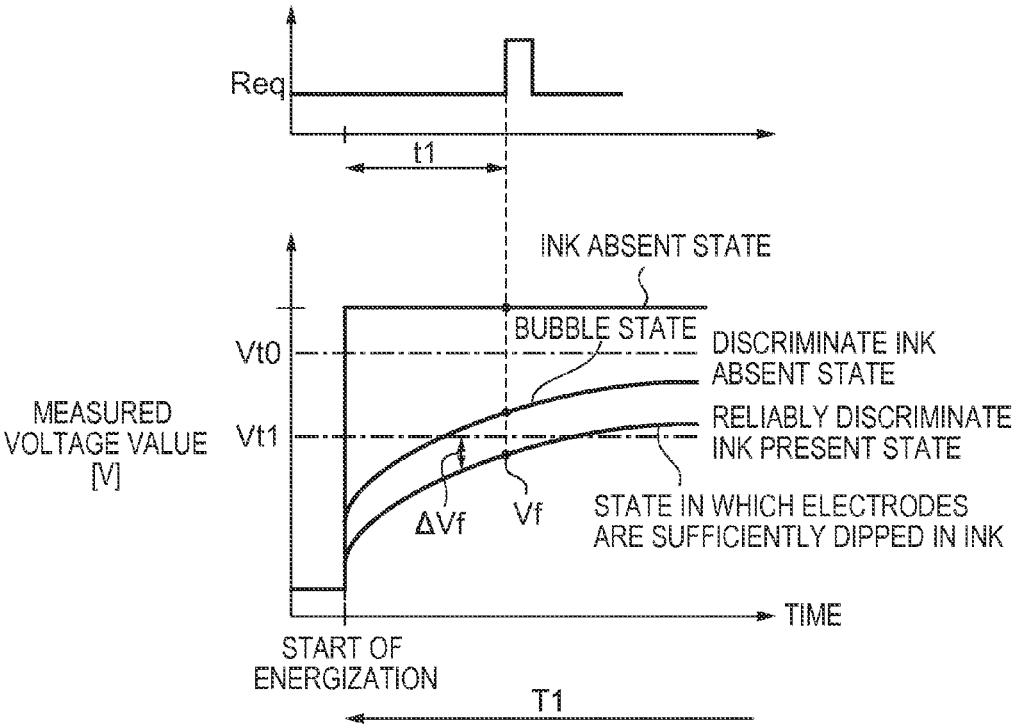
FIG. 10 is a timing chart showing a method of deciding a charge time T1, a threshold voltage Vt0, and a threshold voltage Vt1 in a normal sequence.

FIG. 10 is a timing chart for explaining a method of deciding the charge time T1, the threshold voltage (Vt0: first threshold voltage), and the other threshold voltage (Vt1: second threshold voltage) in the normal sequence.

Referring to FIG. 10, the threshold voltage Vt0 is used to discriminate the ink absent state and should be set near a saturation voltage (3 V in this case). When introducing a bubble detection sequence, another threshold voltage (Vt1: second threshold voltage) lower than the first threshold voltage is provided in addition to the threshold voltage Vt0 of the normal sequence of residual ink detection. The threshold voltage is added because an intermediate voltage is detected in the ink present state or bubble state, as shown in FIG. 4, and when introducing the bubble detection sequence, if the bubble detection sequence is executed every time the measured voltage falls below the threshold voltage (V≤Vt0), the measurement time becomes long, resulting in low efficiency.

In this embodiment, a value Vf+ΔVf obtained by adding a variation ΔVf to a voltage value Vf measured in the time t1 during any desirable charge period T1 in a state in which the electrodes are sufficiently impregnated in ink is set as the other threshold voltage Vt1. By providing the threshold voltage Vt1, when a voltage value that can reliably be regarded as the ink present state (V<Vt1) is measured, the state can be regarded as the ink present state, and the residual ink detection sequence can be ended. Note that since the resistive component is large in the bubble state, as described above, the measured value never becomes smaller than Vt1. On the other hand, when the measured value shifts from the voltage value in the state in which the electrodes are sufficiently impregnated in ink (V≥Vt1), energization by bubbles is suspected. It is therefore possible to execute control to make a transition to the bubble detection sequence.

<Method of Deciding Charge Time T1', Discharge Time T2', and Threshold Voltage Vt2 in Bubble Detection Sequence (FIGS. 11A to 11C)>

The charge time T1', the discharge time T2', and the threshold voltage (Vt2: third threshold voltage) in the bubble detection sequence can be decided using a method to be described below.

Figure 11A:
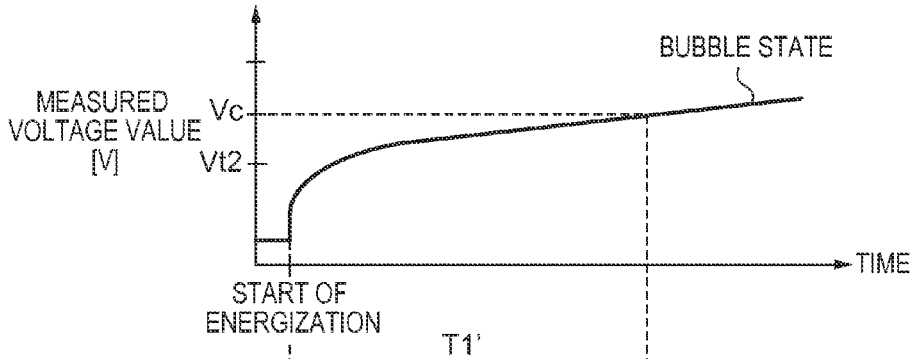
FIGS. 11A, 11B, and 11C are timing charts showing a method of deciding a charge time T1', a discharge time T2', and a threshold voltage Vt2 in a bubble detection sequence.
Figure 11B:
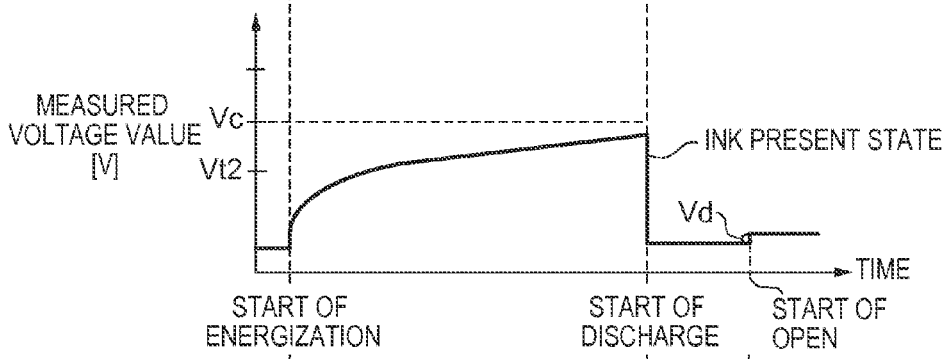
Figure 11C:
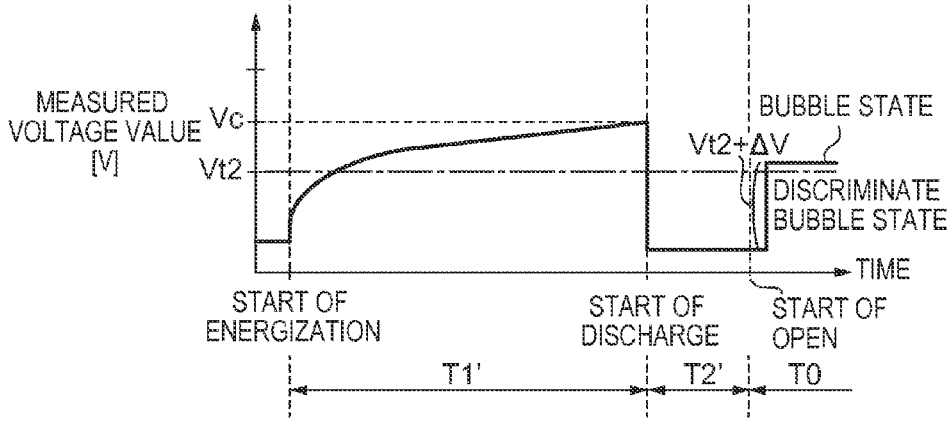

FIGS. 11A to 11C are timing charts for explaining a method of deciding the charge time T1', the discharge time T2', and the threshold voltage Vt2 in the bubble detection sequence.

First, as shown in FIG. 11A, (1) the threshold voltage Vt2 used to discriminate between the bubble state and the ink present state is set to any desirable value, and (2) any desirable voltage value Vc which meets a condition Vc>Vt2 is provided, the electrodes are energized in the bubble state, and charge is performed until the voltage value become Vc.

Next, as shown in FIG. 11B, (3) the electrodes are energized in the ink present state, charge is performed for the time T1', and after that, discharge is performed. This discharge is executed until the voltage value in the open state later (in the time t0 during the open period T0) changes to a voltage value Vd that can be regarded as a state in which the discharge is sufficiently performed. The discharge time at this time is set to T2tmp.

In addition, as shown in FIG. 11C, (4) the electrodes are energized in the bubble state, charge is performed for the time T1', discharge is performed for the time T2tmp, and a voltage value Vo in the open state (in the time t0 during the open period T0) is measured.

(5) When Vo≥Vt2, the discharge time is further adjusted, thereby obtaining the discharge time T2' when Vo=Vt2+ΔV holds. On the other hand, when Vo<Vt2, the voltage value Vc in (2) is set to a large value, and (2) to (5) are repeated, thereby obtaining the discharge time T2' when Vo=Vt2+ΔV holds. However, it is desirable to set Vc to a value equal to or less than the saturation voltage (3 V in this case). When Vc exceeds the saturation voltage, the threshold voltage Vt2 in (1) needs to be reset low.

When (1) to (5) described above are executed, the charge time T1', the discharge time T2', and the threshold voltage Vt2 can be decided.

<Flowcharts of Residual Ink Detection (FIGS. 12 and 13)>

Figure 12:
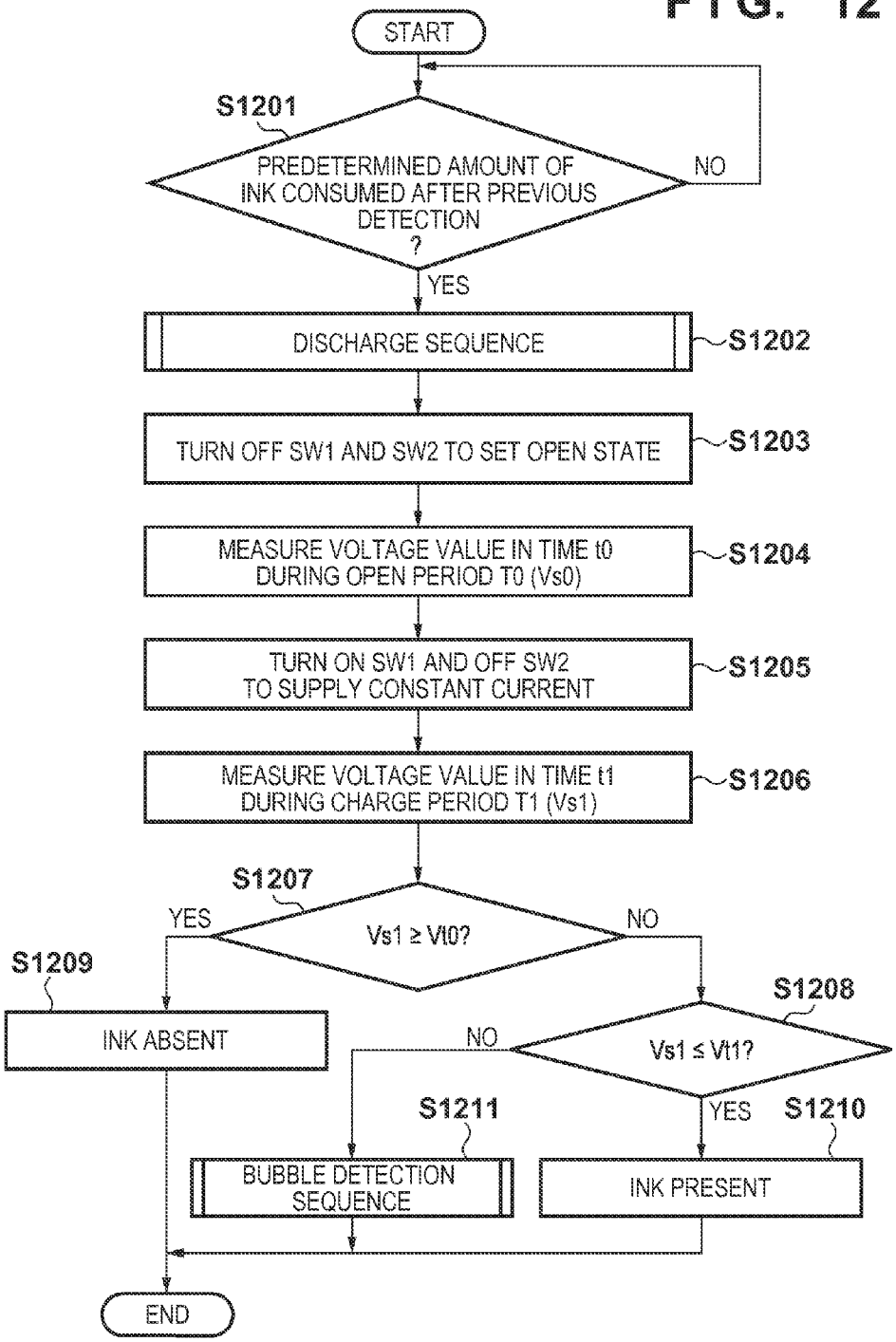
FIG. 12 is a flowchart showing the normal sequence of residual ink detection.

FIG. 12 is a flowchart showing the normal sequence of residual ink detection.

In step S1201, it is checked whether a predetermined amount of ink has been consumed after the previous detection. Upon confirming that the predetermined amount of ink has been consumed, the process advances to step S1202 to execute the discharge sequence. After that, the process advances to step S1203 to turn off the switch (SW1) 602 and the switch (SW2) 603 and set the open state.

Next, in step S1204, voltage measurement is performed in the time t0 during the open period T0. Let Vs0 be the measured voltage value at this time. In step S1205, the switch (SW1) 602 is turned on, and the switch (SW2) 603 is turned off to set the charge state. In step S1206, voltage measurement is performed in the time t1 during the charge period T1. Let Vs1 be the measured voltage value at this time.

In step S1207, the measured voltage value Vs1 is compared with the first threshold voltage Vt0 (first comparison). If Vs1≥Vt0 (equal to or higher than the first threshold voltage) as the result of comparison, the process advances to step S1209 to determine the state as ink absent, and the processing ends. If Vs1<Vt0, the process advances to step S1208. In step S1208, the measured voltage value Vs1 is compared with the second threshold voltage Vt1 (second comparison). If Vs1≤Vt1 (equal to or lower than the second threshold voltage) as the result of comparison, the process advances to step S1210 to determine the state as the ink present state, and the processing ends. If Vs1>Vt1, the process advances to step S1211 to execute the bubble detection sequence. The voltage between the electrodes is thus measured again.

Figure 13:
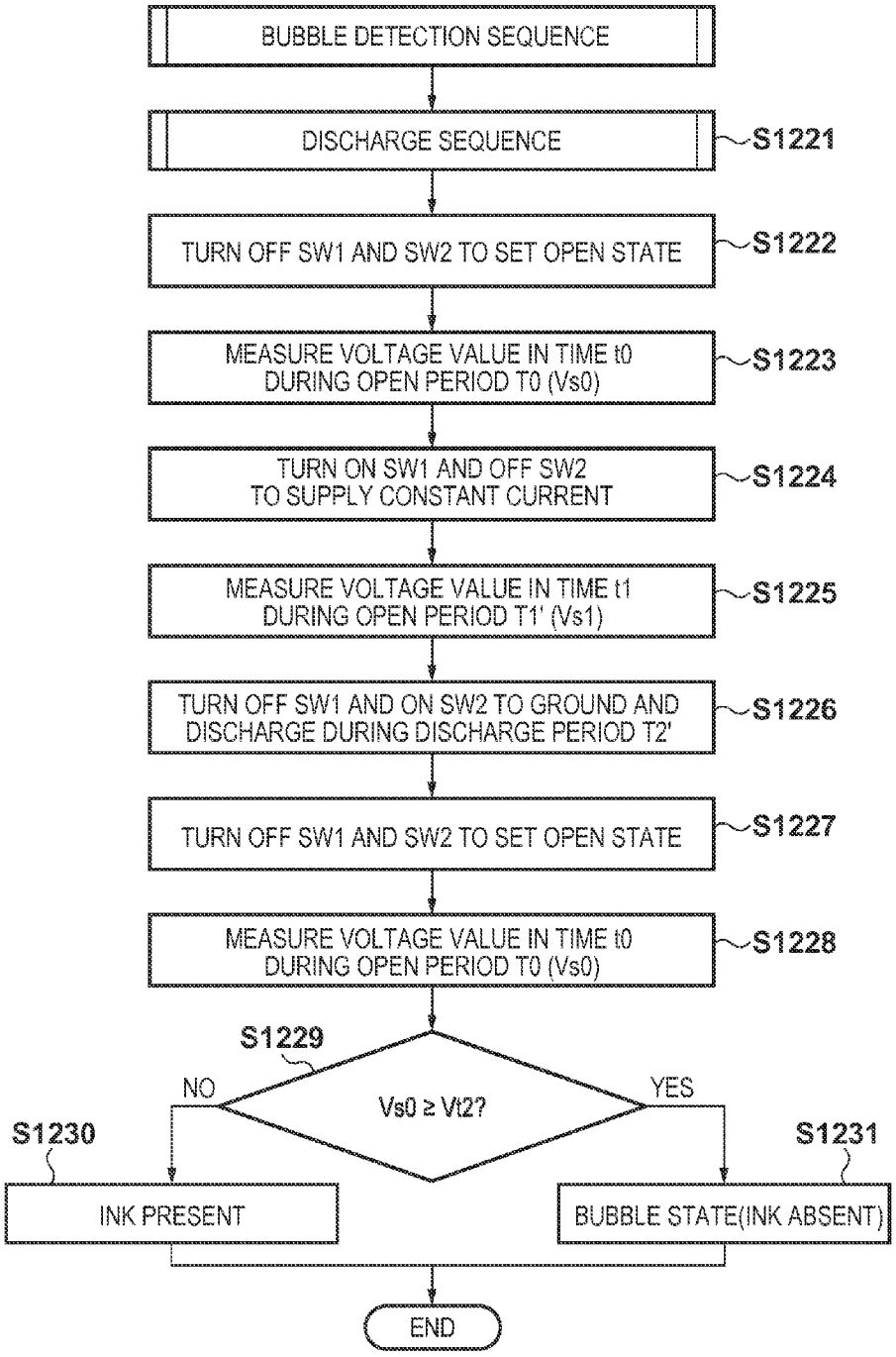
FIG. 13 is a flowchart showing the bubble detection sequence.

FIG. 13 is a flowchart showing the bubble detection sequence.

First, in step S1221, the discharge sequence is executed. Next, in step S1222, the switch (SW1) 602 and the switch (SW2) 603 are turned off to set the open state. In step S1223, voltage measurement is performed in the time t0 during the open period T0. Let Vs0 be the measured voltage value at this time. In step S1224, the switch (SW1) 602 is turned on, and the switch (SW2) 603 is turned off to set the charge state.

In step S1225, voltage measurement is performed in the time t1 during the charge period T1'. Let Vs1 be the voltage value at this time. In step S1226, the switch (SW1) 602 is turned off, and the switch (SW2) 603 is turned on to set the ground discharge state during the discharge period T2'. After that, in step S1227, the switch (SW1) 602 is turned off, and the switch (SW2) 603 is turned off to set the open state. In step S1228, voltage measurement is performed in the time t0 during the open period T0. Let Vs0 be the measured voltage value at this time.

In step S1229, the measured voltage value Vs0 is compared with the third threshold voltage Vt2 (third comparison). If Vs0≥Vt2 (equal to or higher than the third threshold voltage), the process advances to step S1231 to determine the state as the bubble state (ink absent state), and after that, the processing ends. If Vs0<Vt2, the process advances to step S1230 to determine the state as the ink present state, and the processing ends.

<Ink Vt2 (FIGS. 14A and 14B)>

Figure 14A:
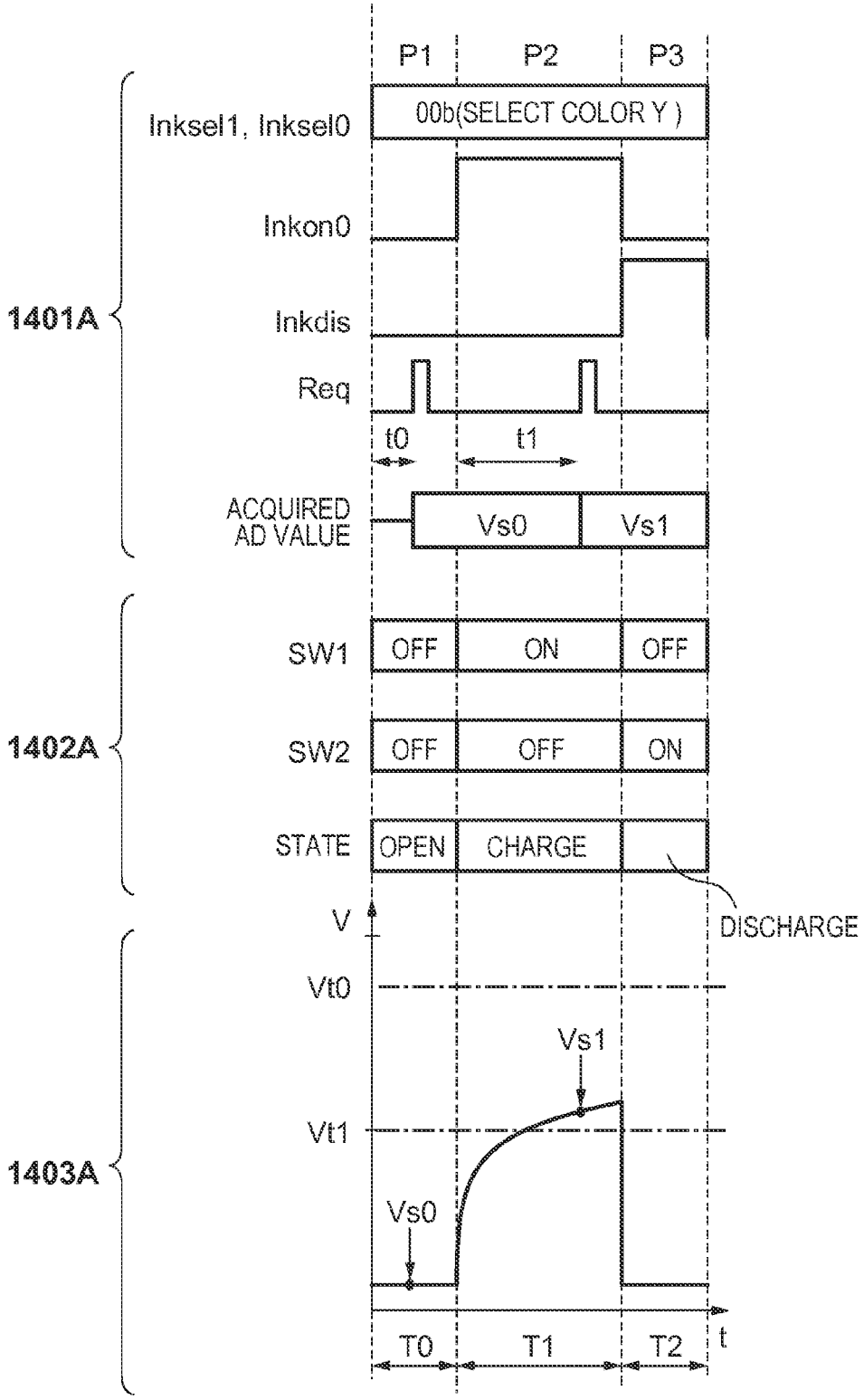
FIGS. 14A and 14B are timing charts of residual ink detection.
Figure 14B:
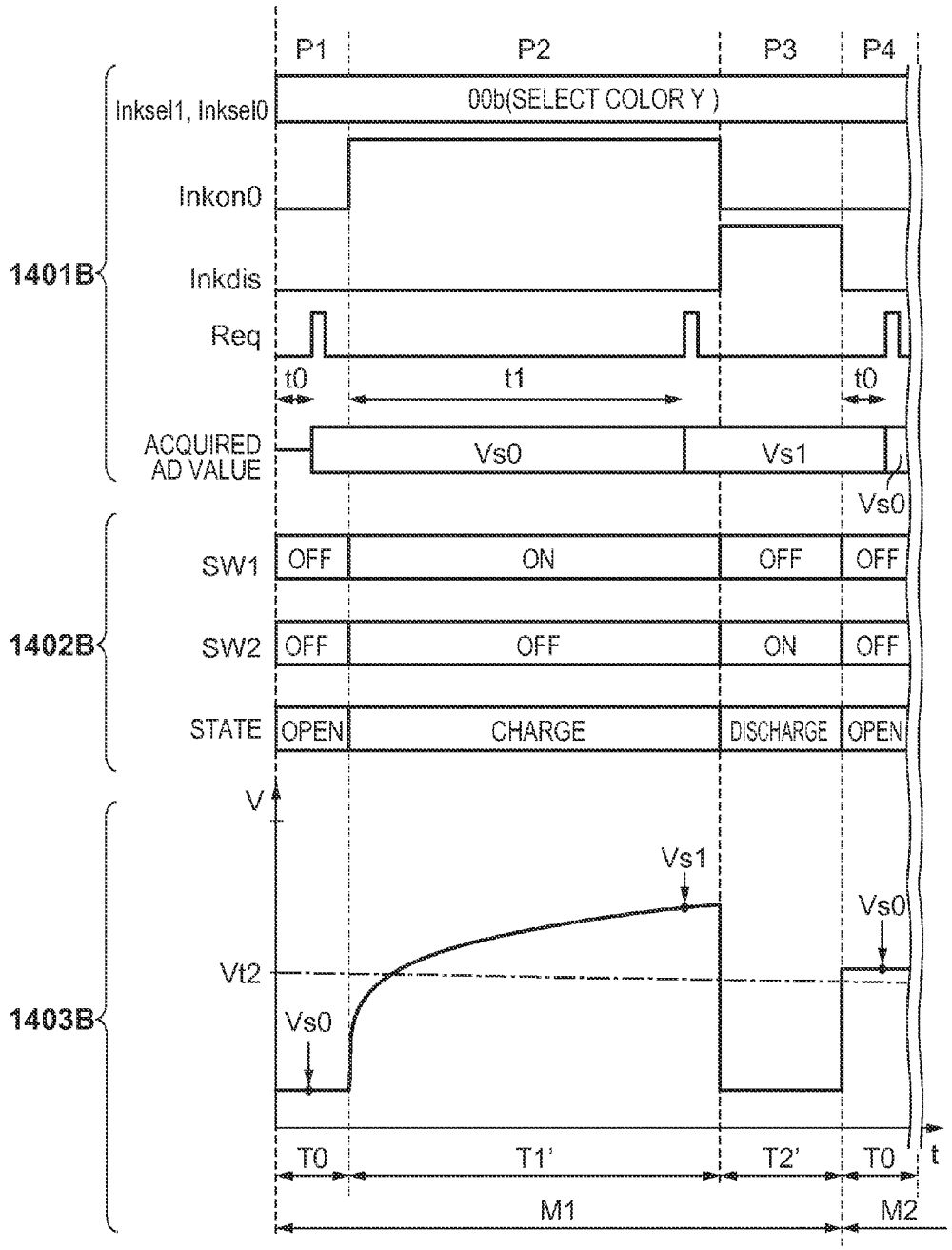

FIGS. 14A and 14B are timing charts of residual ink detection. FIG. 14A is a timing chart in the normal sequence (FIG. 12), and FIG. 14B is a timing chart in the bubble detection sequence (FIG. 13). Each of FIGS. 14A and 14B shows, from the upper side, a change in the control signal of the residual ink level measurement control circuit 541 (1401A, 1401B), the states of the switch (SW1) and the switch (SW2) and the state of the electrodes (1402A, 1402B), and the voltage waveform at the point 610 in the bubble state (1403A, 1403B).

As shown in FIG. 14A, since the AD value Vs1 acquired during the charge period (P2) meets Vt1<Vs1<<Vt0, residual ink detection moves to the bubble detection sequence. As shown in FIG. 14B, since the AD value Vs0 acquired during the open period (P4) meets Vt2<Vs0, and bubbles can be determined. For this reason, the state is determined as the ink absent state, and the processing ends.

Hence, according to the above-described embodiment, in the normal sequence, the presence/absence of ink is determined using two threshold voltages. When bubbles exist, and the determination is suspected, the ink state can be re-inspected by executing the bubble detection sequence.

More specifically, the connection state of a pair of electrodes is sequentially switched to charge, discharge, and open. The voltage value is measured at the time of charge in the normal sequence, or at the time of open in the bubble detection sequence. Threshold voltages are provided for the respective measured voltage values, and they are compared, thereby determining a short circuit by bubbles even in a state in which the electrodes are shorted by bubbles generated from ink in an ink tank.

By employing this arrangement, more reliable residual ink detection can be performed. This also makes it possible to reliably avoid an unwanted current from flowing to the circuit and perform more reliable heater driving control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-178563, filed Aug. 29, 2013, which is hereby incorporated by reference herein in its entirety.

What is claimed is:

1. A printing apparatus comprising:

an ink tank containing ink;

two electrodes provided in said ink tank;

a measurement unit configured to perform a measurement operation for measuring a voltage difference between the two electrodes;

a determination unit configured to determine that an ink amount in said ink tank is in a first state indicating that the ink amount is less than a predetermined amount in a case where the voltage difference measured by said measurement unit is higher than a first threshold value, and determine that the ink amount is in a second state indicating that the ink amount is more than the predetermined amount in a case where the measured voltage difference is lower than a second threshold value lower than the first threshold value; and a control unit configured to control to cause said measurement unit to perform re-measurement after discharging electric charges accumulated between the two electrodes in a case where the voltage difference measured by said measurement unit is higher than the second threshold value and lower than the first threshold value.

2. The apparatus according to claim 1, further comprising:

an inkjet printhead configured to print by the ink supplied from said ink tank;

a supply unit configured to supply an electric current to one of the two electrodes for the measurement by said measurement unit;

a first comparison unit configured to compare the voltage difference measured by said measurement unit with the first threshold value; and a second comparison unit configured to compare the voltage difference measured by said measurement unit with the second threshold value.

3. The apparatus according to claim 2, wherein said control unit includes a third comparison unit configured to compare the voltage difference measured by said measurement unit in the re-measurement of said ink tank with a third threshold value, and said determination unit determines that the ink amount is in the first state in a case where the measured voltage difference is higher than the third threshold value as a result of the comparison by said third comparison unit, and determines that the ink amount is in the second state in a case where the voltage difference measured by the re-measurement is lower than the third threshold value.

4. The apparatus according to claim 2, wherein a plurality of said ink tanks, each configured to store inks of different colors are provided, and further comprising a selection unit configured to select an ink tank for which residual ink detection is to be performed, out of the plurality of ink tanks.

5. The apparatus according to claim 3, further comprising:

a first switch configured to turn on/off the electric current to be supplied from said supply unit to the one electrode; and a second switch configured to turn on/off connection of the one electrode to ground, wherein said supply unit includes a constant current source, the other electrode of the two electrodes is grounded, said first switch and said second switch are connected to each other, and said measurement unit measures the voltage difference between said first switch and said second switch.

6. The apparatus according to claim 4, wherein said selection unit connects the ink tank for which the residual ink detection is to be performed to said supply unit and said measurement unit.

7. The apparatus according to claim 5, wherein the two electrodes is in (1) an open state in a case where said first switch is off, and said second switch is off, (2) a charge state in a case where said first switch is on, and said second switch is off, and (3) a discharge state in a case where said first switch is off, and said second switch is on.

8. The apparatus according to claim 7, wherein the state of the two electrodes sequentially repeats the open state, the charge state, and the discharge state by a combination of on/off of said first switch and said second switch.

9. The apparatus according to claim 8, wherein the voltage difference measured by said measurement unit in the charge state is compared with the first threshold value by said first comparison unit, and with the second threshold value by said second comparison unit.

10. The apparatus according to claim 8, wherein in the re-measurement of said ink tank under control of said control unit, the voltage difference measured by said measurement unit when the open state, the charge state, and the discharge state sequentially continue, and the open state is set again is compared with the third threshold value by said third comparison unit.

11. The apparatus according to claim 1, wherein residual ink detection is performed every time a predetermined amount of ink is consumed.

12. The apparatus according to claim 1, wherein said determination unit is further configured to determine that the ink amount is in the first state in a case where the voltage difference measured by said measurement unit in the re-measurement is higher than a third threshold value, and determine that the ink amount is in the second state in a case where the voltage difference is less than the third threshold value.

13. The apparatus according to claim 1, further comprising:

a supply unit configured to be able to supply an electric current to at least one of the two electrodes;

a first switch configured to be able to switch between a connection state in which said supply unit is connected to the one electrode and a non-connection state in which said supply unit is not connected to the one electrode;

a second switch configured to be able to switch between a grounded state in which the one electrode is grounded and a non-grounded state in which the one electrode is not grounded, wherein said control unit is further configured to control to cause said first switch to switch to the non-connection state and cause said second switch to switch to the grounded state so as to discharge the electric charges accumulated between the two electrodes.

14. A residual ink detection method in a printing apparatus including an ink tank in which two electrodes are provided, comprising:

performing a measurement operation for measuring a voltage difference between the two electrodes;

determining that an ink amount in the ink tank is in a first state indicating that the ink amount is less than a predetermined amount in a case where the measured voltage difference is higher than a first threshold value;

determining that the ink amount is in a second state indicating that the ink amount is more than the predetermined amount in a case where the measured voltage difference is lower than a second threshold value lower than the first threshold value; and controlling to perform re-measurement after discharging electric charges accumulated between the two electrodes in case where the measured voltage difference is higher than the second threshold value and lower than the first threshold value.

15. The method according to claim 14, further comprising:

supplying an electric current to one of the two electrodes for the measurement;

comparing the measured voltage difference with the first threshold value; and comparing the measured voltage difference with the second threshold value.

16. The method according to claim 15, further comprising comparing the voltage difference obtained by the re-measurement of the ink tank with a third threshold value, wherein in the determining, it is determined that the ink amount is in the first state in a case where the voltage difference obtained by the re-measurement is higher than the third threshold value as a result of the comparison between the third threshold value and the voltage difference obtained by the re-measurement, and that the ink amount is in the second state in a case where the voltage difference obtained by the re-measurement is lower than the third threshold value.

17. The method according to claim 14, wherein residual ink detection is performed every time an inkjet printhead consumes a predetermined amount of ink.

18. A printing apparatus comprising:

an ink tank containing ink;

two electrodes provided in said ink tank;

a measurement unit configured to perform a measurement operation for measuring a voltage difference between said two electrodes;

a supply unit configured to be able to supply an electric current to at least one of said two electrodes;

a first switch configured to be able to switch between a connection state in which said supply unit is connected to the one electrode and a non-connection state in which said supply unit is not connected to the one electrode;

a second switch configured to be able to switch between a grounded state in which the one electrode is grounded and a non-grounded state in which the one electrode is not grounded, a determination unit configured to in the connection state and the non-grounded state, determine that an ink amount in said ink tank is in a first state indicating that the ink amount is less than a predetermined amount in a case where the voltage difference measured by said measurement unit is higher than a first threshold value, and determine that the ink amount is in a second state indicating that the ink amount is more than the predetermined amount in a case where the measured voltage difference is lower than a second threshold value lower than the first threshold value; and a control unit configured to control to cause said measurement unit to perform re-measurement after causing said first switch to switch to the non-connection state, causing said second switch to switch to the grounded state, and then causing said second switch to switch to the non-grounded state in a case where the voltage difference measured by said measurement unit is higher than the second threshold value and lower than the first threshold value.

19. The apparatus according to claim 18, wherein said determination unit is further configured to determine that the ink amount is in the first state in a case where the voltage difference measured by said measurement unit in the re-measurement is higher than a third threshold value, and determine that the ink amount is in the second state in a case where the voltage difference is less than the third threshold value.

* * * * *